US005683193A

United States Patent [19]

Cerri

[11] Patent Number: 5,683,193

[45] Date of Patent: Nov. 4, 1997

[54] DEVICE FOR RETAINING SHEETS FILES OR PUNCHED CARDS IN BINDERS OR THE LIKE

[75] Inventor: Luciano Cerri, Magenta, Italy

[73] Assignee: Tecnocart S.a.s. di Giovanni Leopoldo Cerri & C., Marcallo Con Casone, Italy

[21] Appl. No.: 657,213

[22] Filed: Jun. 3, 1996

[30] Foreign Application Priority Data

Jun. 14, 1995 [IT] Italy ..... MI95A1275

[51] Int. Cl.[6] ..... B42F 3/04

[52] U.S. Cl. ..... 402/20; 402/26; 402/73

[58] Field of Search ..... 402/26, 68, 70, 402/73, 28, 19, 20

[56] References Cited

U.S. PATENT DOCUMENTS 4,790,680 12/1988 Givati et al. ..... 402/68
5,405,209 4/1995 Johns et al. ..... 402/26 X

*Primary Examiner*—Willmon Fridie, Jr.
*Attorney, Agent, or Firm*—Guido Modiano; Albert Josif; Daniel J. O'Byrne

[57] ABSTRACT

The device for retaining sheets, files, or punched cards in binders has a body defining a base portion that can be associated with the cover of a binder. Two arms extend from the base portion and constitute the two arms of an open ring. The two arms can move towards each other at their free ends, which lie opposite to the base portion. The free ends are provided respectively with a tooth and a seat, for mutual engagement. The tooth can be engaged with or released from the seat to close or open the ring.

17 Claims, 4 Drawing Sheets

DEVICE FOR RETAINING SHEETS FILES OR PUNCHED CARDS IN BINDERS OR THE LIKE

BACKGROUND OF THE INVENTION

The present invention relates to a device for retaining sheets, files, or punched cards in binders or the like.

It is known that the devices currently in use for retaining sheets, files, or punched cards inside binders are generally constituted by steel mechanisms, having various shapes and dimensions, that are provided with a plurality of rings, each of which is composed of two halves that can be separated to insert the various pre-perforated sheets, in contrast with the action applied by appropriate springs that achieve, for each ring, an opening position and a closure position.

The use of this conventional device has some drawbacks.

First of all, these steel mechanisms can very easily cause injuries to the user's hands during the operation for ring closure, which occurs suddenly due to the action applied by the springs.

Another problem consists in the difficulty in disposing of old binders provided with these steel devices in an environment-friendly manner, since in order to permit separate-collection of the different materials constituting such binders, it is necessary to first detach the steel devices from the cover, which is usually made of cardboard.

These devices also have a relatively complicated structure that significantly affects production and assembly costs.

Another problem is constituted by the fact that a partial breakage or damage of the device usually necessitates replacement of the entire binder.

SUMMARY OF THE INVENTION

The aim of the present invention is to solve the above described problems by providing a device for retaining sheets, files, or punched cards in binders or the like that is very practical and handy in use and offers a high degree safety against the danger of accidental injury.

Within the scope of this aim, an object of the present invention is to provide a device that is structurally simple and can be manufactured with considerably lower production costs than those of currently commercially available binder devices.

Another object of the present invention is to provide a device that considerably simplifies the operations for the disposal of the binders once they have reached the end of their working life.

With this aim, these and other objects in view, there is provided a device for retaining sheets, files, or punched cards in binders or the like, characterized in that it comprises a body having a base portion connectable to the cover of a binder or the like and two arms that extend from said base portion and constitute the two arms of an open ring, said two arms being movable toward each other by means of their free ends, which lie opposite to said base portion, said free ends being also provided with mutual engagement means that can be activated or deactivated to close or open said ring.

BRIEF DESCRIPTION OF THE DRAWINGS

Further characteristics and advantages of the invention will become apparent from the description of a preferred but not exclusive embodiment of the device according to the invention, illustrated only by way of non-limitative example in the accompanying drawings, wherein.

DESCRIPTION OF THE PREFERRED EMBODIMENTS

Figure 1:
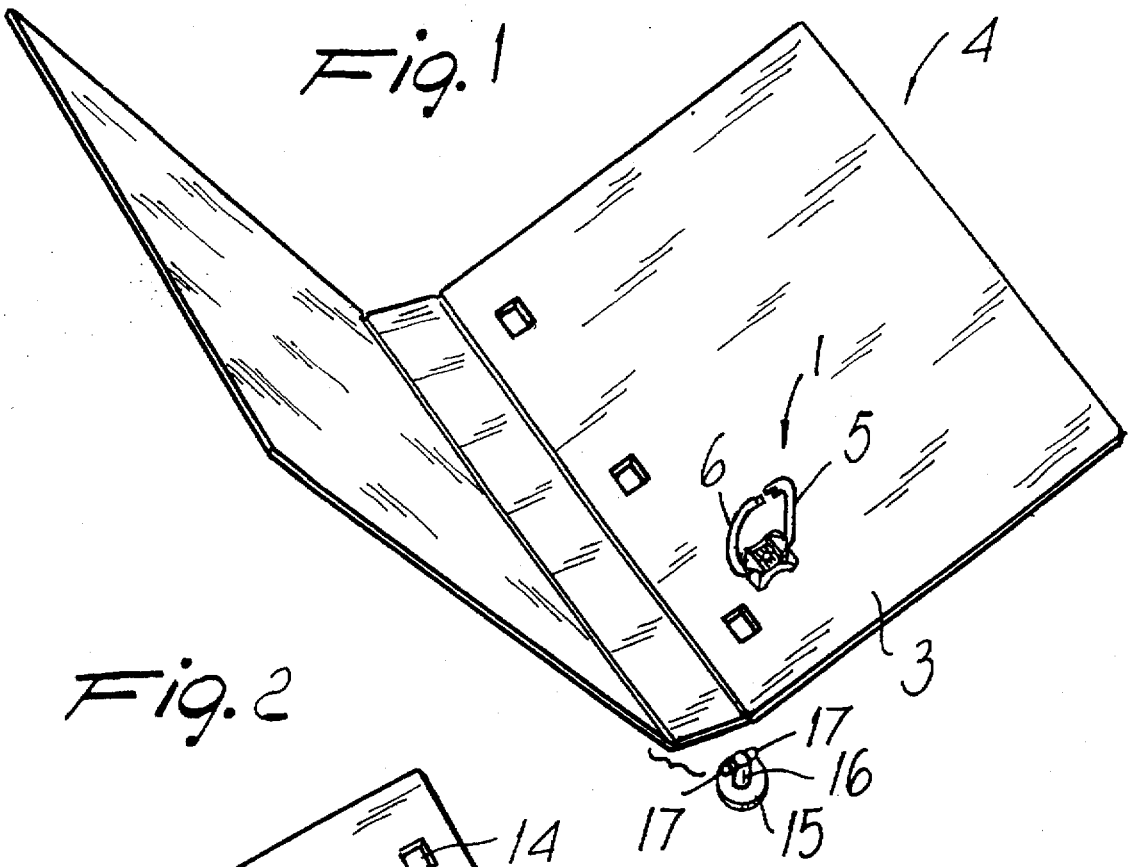
FIG. 1 is an exploded perspective view of an open binder with a device according to the invention.
Figure 2:
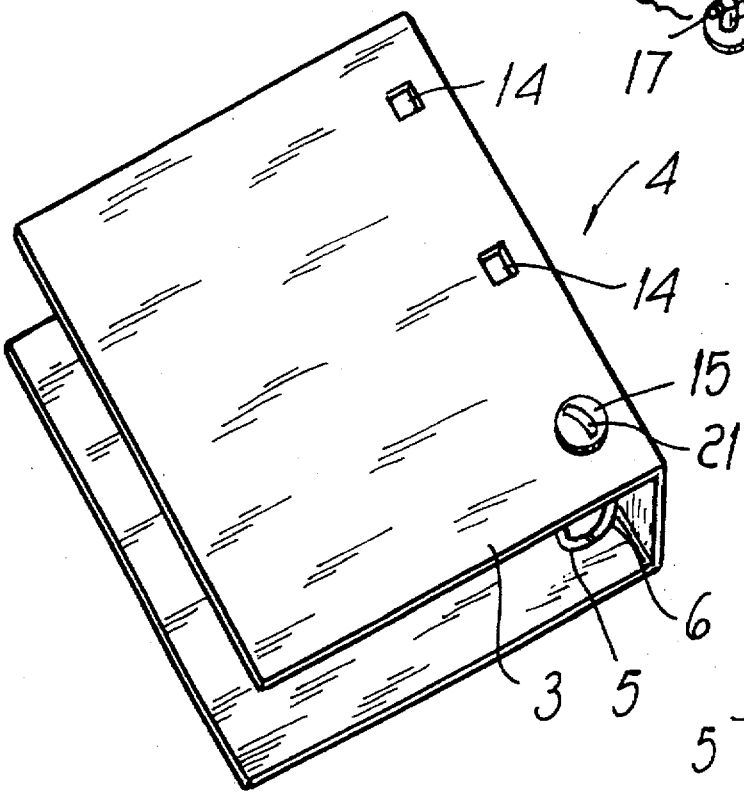
FIG. 2 is a view of the binder of FIG. 1, shown in a closed position and seen from the rear side of its cover.
Figure 3:
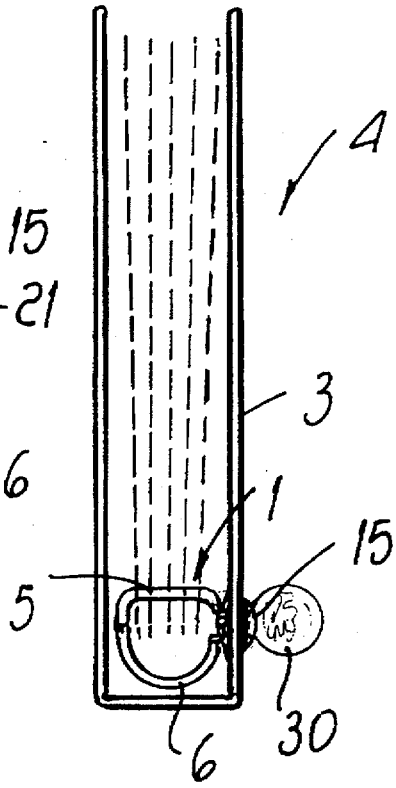
FIG. 3 is a top plan view of said binder in a closed position.
Figure 4:
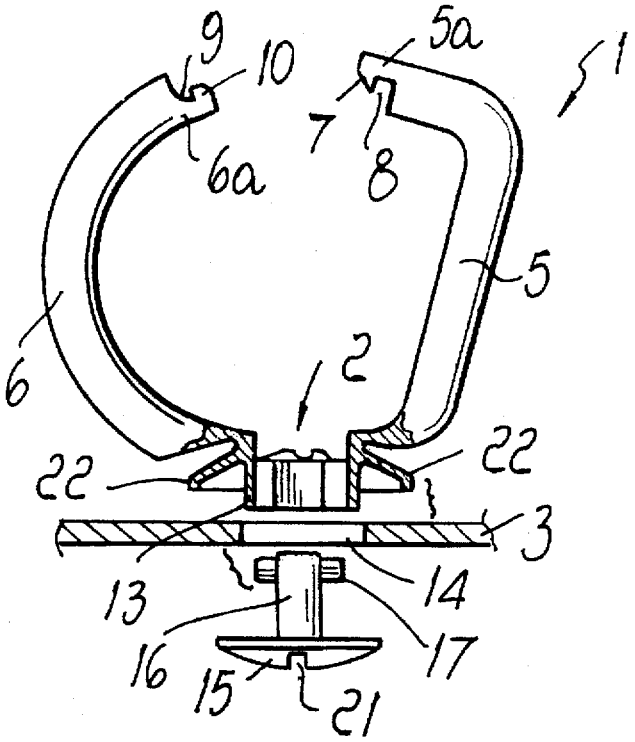
FIG. 4 is a partially sectional lateral elevation view of the device according to the invention during its application to a cover.
Figure 5:
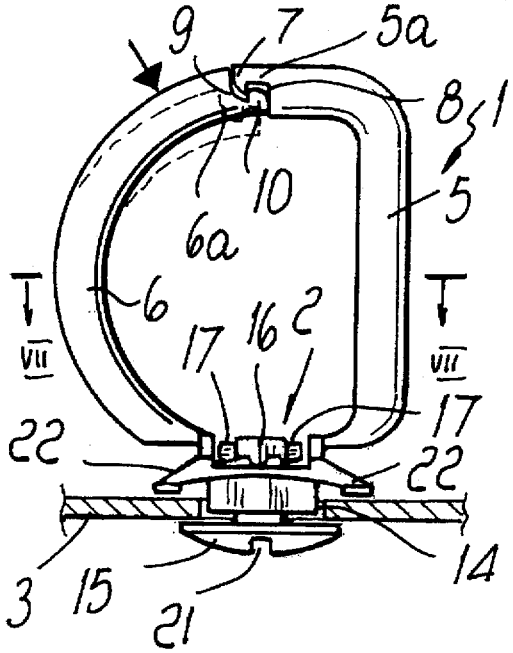
FIG. 5 is a lateral elevation view of the device according to the invention, in an intermediate stage of its application to a cover.
Figure 6:
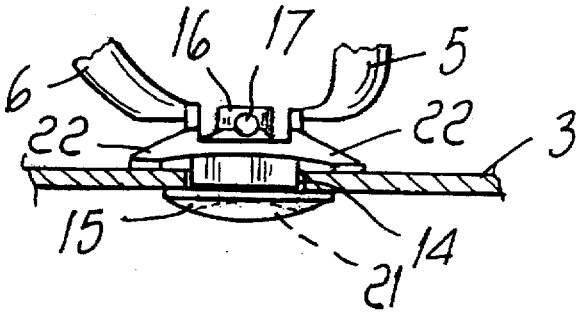
FIG. 6 is a lateral elevation view of a detail of the device according to the invention, at the end of the operation for applying it to the cover.
Figure 7:
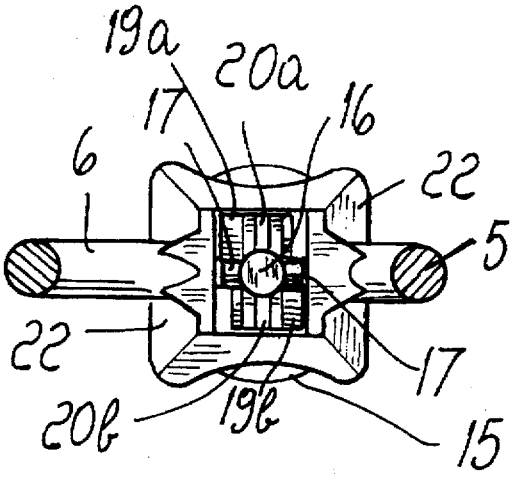
FIG. 7 is a sectional view of FIG. 5, taken along the plane VII—VII.
Figure 8:
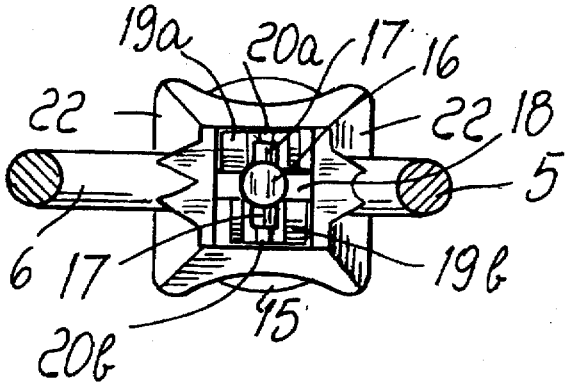
FIG. 8 is a sectional view of the device according to the invention, similar to FIG. 7, at the end of the operation for applying the device to the cover.
Figure 9:
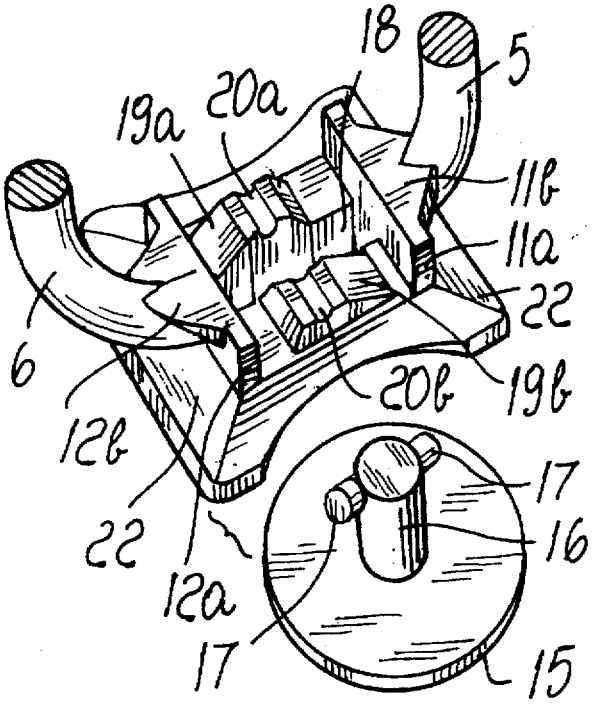
FIG. 9 is an exploded perspective view of a portion of the device according to the invention.

With reference to the above figures, the device according to the invention, comprises a body 1 preferably made of molded synthetic material that has a base portion 2, which is associable with the cover 3 of a binder 4 or the like, and two arms 5 and 6 that extend from the base portion 2 and constitute the two arms of an open ring.

The two arms 5 and 6 can be moved mutually closer with their free ends 5*a* and 6*a*, i.e., their ends that are opposite with respect to the base portion 2; said free ends 5*a* and 6*a* are provided with mutual engagement means that can be activated or deactivated to close or open the ring constituted by the two arms 5 and 6.

More particularly, the two arms 5 and 6 and the base portion 2 are preferably formed monolithically.

The two arms 5 and 6 can be moved mutually closer or further apart with their free ends 5*a* and 6*a* as a consequence of the elastic flexural deformability of said arms 5 and 6 and/or of the base portion 2.

The body made of synthetic material, constituted by the base portion 2 and by the two arms 5 and 6, is molded monolithically with the two arms 5 and 6, which are mutually disengaged and spaced apart.

Consequently, when the mutual engagement means located at the free ends 5*a* and 6*a* of the two arms 5 and 6 are deactivated, and when no force is applied to the two arms 5 and 6, the two free ends 5*a* and 6*a* are mutually spaced.

The mutual engagement means supported by the free ends 5*a* and 6*a* comprise, on the arm 5, a tooth 7 and a seat 8 that can engage in a snap-together fashion, by mutual overlap, respectively a seat 9 and a tooth 10 that are formed on the free end 6a of the other arm 6. The two arms 5 and 6 have, in transverse cross-section, a circular shape except for their free end 5a and 6a and for the region for connection to the base portion 2.

The two arms 5 and 6 are connected to the base portion 2 by means of a flap that is composed of a first portion 11a and 12a, which rises vertically from the base portion 2, and of a second portion 11b, 12b, which extends at right angles to the first portion 11a, 12a, i.e., horizontally. This particular connection existing between the arms 5 and 6 and the base portion 2 ensures high elastic flexural deformability of the two arms 5 and 6 toward and away from each other.

The arm 6, which in the illustrated embodiment is directed toward the central spine of the cover, conveniently has a shape with a continuous curvature, whereas the other arm 5 is formed with a shape that is composed of two portions that mutually intersect at right angles.

The device according to the invention is also provided with means for removable engagement of the base portion 2 with the cover 3 of the binder 4.

More particularly, the base portion 2 is provided with a foot 13 that has a prism-like shape and can be inserted, from the inner side of the cover 3, in a through seat 14 that is formed correspondingly in the cover 3 of the binder 4. The removable engagement means comprise a button 15 that is associable with the foot 13 of the base portion 2 on the outer side of the cover 3 to clamp the cover between the base portion 2 and the button 15.

The button 15 is provided, on one of its faces, with a pivot 16 that has, proximate to its opposite end with respect to the button 15, a pair of transverse tabs 17 that protrude in mutually diametrically opposite regions. Said pivot 16 can be inserted through an elongated slot 18 that is formed in the base portion 2 and can rotate about its axis relative to the base portion 2 to move the tabs 17 transversely to the elongated slot 18, thus producing the stable connection of the button 15 to the base portion 2.

The base portion 2, on its side directed away from the button 15, is provided, around the elongated slot 18, with a path formed by inclined planes 19a and 19b that end with recesses 20a and 20b for accommodating the transverse tabs 17.

The button 15 has, on its opposite side with respect to the pivot 16, a maneuvering slot 21 by means of which it is possible to turn the button 15 about the axis of the pivot 16 in a very simple manner with a coin 30, with a screwdriver, or with another blade-fitted tool.

The base portion 2 is also provided, laterally to the foot 13, with flaps 22 for resting against the inner side of the cover 3.

Figure 10:
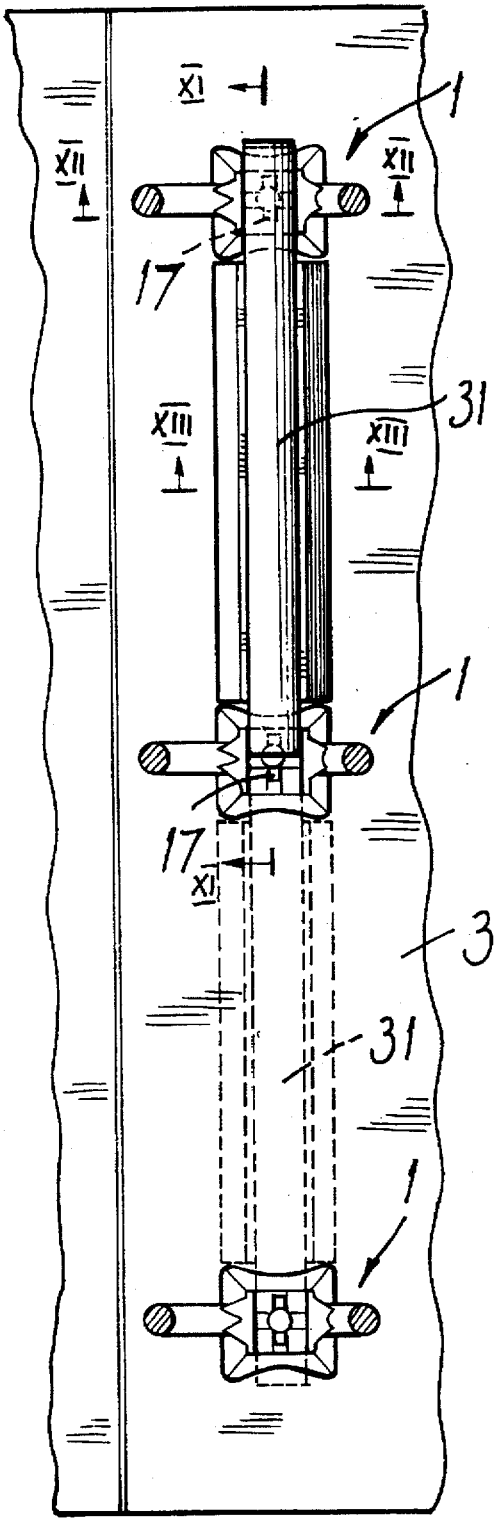
FIG. 10 is a top-plan view of a plurality of devices, according to the invention, interconnected by bars.
Figure 11:
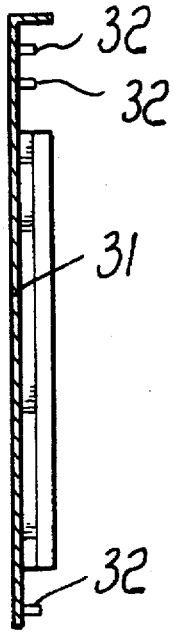
FIG. 11 is a sectional view of one of the bars shown in FIG. 10, taken on the plan XI—XI.
Figure 12:
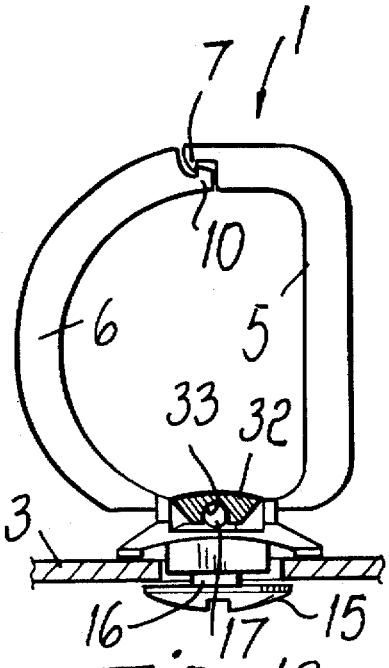
FIG. 12 is an enlarged sectional view taken on the plane XII—XII of FIG. 10.
Figure 13:
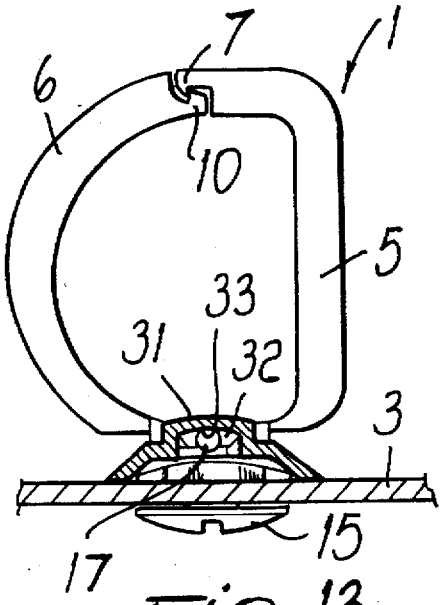
FIG. 13 is an enlarged sectional view taken on the plane XIII—XIII of FIG. 10.

Advantageously, as illustrated in FIGS. 10–13, bars 31 may be provided for interconnecting two contiguous bodies 1 of the devices of the above-described type, after they have been connected to the cover 3 by means of respective buttons 15.

The bars 31, which may also be made of molded synthetic material, have protuberances 32 located on a portion thereof which is adapted to face the cover.

The protuberances 32 have a wing-like shape and define a cavity 33 which can be press-fitted onto one of the tabs 17 of a pivot 16 of a respective button 15.

Thus, a connection rib is provided between a plurality of devices according to the invention, in an aesthetically pleasing manner.

The use of the device according to the invention is as follows.

According to the requirements, binders with a variable number of devices according to the invention are produced.

It should be noted that the devices according to the invention can be supplied unassembled to the cover of the binder, leaving this operation to the end user, so as to considerably reduce costs linked to transport and storage, thus reducing the total cost of the binder.

The device is assembled to the cover 4 by using the button 15, which is inserted with the transverse tabs 17 of the pivot 16 through the elongated slot 18 of the base portion 2 and then fixed stably to said base portion 2, partially turning it about the axis of the pivot 16. The engagement of the transverse tabs 17 along the inclined paths 19a and 19b causes the gradual clamping of the cover 3 between the flaps 22 of the base portion 2 and the button 15 as well as the subsequent stable retention of the transverse tabs 17 in the recesses 20a and 20b. Successively, the bodies 1 of the devices can be interconnected by means of the bars 31.

With the device thus rigidly coupled to the cover 3, it is possible to engage the sheets, files, or punched cards with the arms 5 and 6 of the device, simply by opening the ring constituted by the arms 5 and 6 by virtue of the disengagement of the teeth 7 and 10 from the corresponding seats 8 and 9. As a consequence of the disengagement of the teeth 7 and 10 from the seats 8 and 9, which can be achieved simply by applying a slight pressure to the arm 6, the elasticity of the material of which the device is made causes the mutual spacing of the free ends 5a and 6a of the arms 5 and 6, thus allowing to insert the arms 5 and 6 in the holes formed in the sheets, in the files, or in the cards to be cataloged. After the insertion of the arms 5 or 6 in the holes of the sheets to be cataloged, the two arms 5 and 6 can be moved mutually closer in contrast with the elastic reaction of the material, mutually overlapping the free ends 5a and 6a, with consequent snap-action engagement of the teeth 7 and 10 in the seats 8 and 9. In this manner, the ring constituted by the arms 5 and 6 is stably closed and retains the sheets inside the binder.

In practice it has been observed that the device according to the invention fully achieves the intended aim, since by being provided with mutual engagement means at the free ends of the two arms that compose each ring, it is extremely practical and easy to use and safely avoids the possibility of accidental injury to the user.

Another advantage of the device according to the invention is that it can be produced in various colors, according to the image and design requirements that the market demands in each case.

An additional advantage is that it allows the user, if damage occurs to a ring inside a binder, to replace just the damaged ring without having to replace the entire binder.

The device thus conceived is susceptible of numerous modifications and variations, all of which are within the scope of the inventive concept; all the details may furthermore be replaced with other technically equivalent elements.

In practice, the materials employed, as well as the dimensions, may be any according to the requirements and the state of the art.

What is claimed is:

1. A device for retaining sheets, files, or punched cards in binders or the like, comprising a body having a single base portion that is connectable to an inner side of the cover of a binder or the like and two arms that extend from said base portion and constitute the two arms of an open ring, said two arms being formed monolithically with said single base portion and being movable toward each other by means of their free ends, which lie opposite to said base portion, said free ends being also provided with mutual engagement means that can be activated or deactivated to close or open said ring.

2. A device according to claim 1, wherein said body is made of molded synthetic material.

3. A device according to claim 1, wherein said arms can be moved mutually closer or further apart with their free ends as a consequence of the flexural elastic deformability of said two arms and/or of said base portion.

4. A device according to claim 1, wherein when said mutual engagement means are deactivated and when no forces are applied to said two arms, the free ends of said two arms are mutually spaced.

5. A device according to claim 1, wherein said mutual engagement means comprise at least one tooth that is provided on the free end of one of said two arms and can be engaged in a snap-together manner with a seat that is correspondingly formed in the free end of the other one of said two arms.

6. A device according to claim 1, wherein said mutual engagement means comprise, for each one of two arms, a tooth and a seat that can engage in a snap-together manner, by mutual overlap, respectively with a seat and a tooth formed on the other one of said two arms.

7. A device according to claim 1, wherein said two arms have, in a transverse cross-section, a circular shape except for their free end and for the region for connection to said base portion.

8. A device according to claim 1, wherein said two arms are connected to said base portion by means of a flap that has a first portion that extends vertically from said base portion and a second portion that is joined to one of said two arms and lies horizontally.

9. A device according to claim 1, wherein it comprises means for the detachable engagement of said base portion with the cover of the binder or the like.

10. A device according to claim 1, wherein said base portion has a foot that has a prismatic shape and can be inserted, from the inner side of the cover, in a through seat that is formed correspondingly in the cover of the binder or the like, said detachable engagement means comprising a button that is associable with the foot of said base portion on the outer side of the cover to clamp the cover between said base portion and said button.

11. A device according to claim 10, wherein said button has a head with a pivot that is provided with a pair of diametrically opposite transverse tabs, said pivot being insertable through an elongated slot that is formed in said base portion and being able to rotate about its own axis relative to said base portion to move said tabs transversely to said elongated slot, performing the stable connection of said button to said base portion.

12. A device according to claim 11, wherein said base portion has, on its side that is directed away from said button, around said elongated slot, a path formed by inclined planes for said transverse tabs of the pivot of the button, said planes ending with recesses for accommodating said transverse tabs.

13. A device according to claim 10, wherein said base portion has, laterally to said foot, flaps for resting against the inner side of the cover.

14. A device according to claim 10, wherein said button has a maneuvering slot on its side that is directed away from said pivot.

15. A device according to claim 10, wherein it comprises at least one bar connectable to said body for interconnecting at least two contiguous bodies, substantially identical to said body, said bar being connectable to the cover of a binder.

16. A device according to claim 15, wherein said bar has, on a side thereof adapted to face a cover of a binder, protuberances adapted for press-fitting engagement with said tabs of said pivot defined by the buttons engaged with said base portion of each of said at least two contiguous bodies.

17. A binder for retaining sheets, files, or punched cards, wherein it comprises a cover to which at least one device according to claim 1 is detachably applied.

* * * * *